US008653715B1

(12) United States Patent
Baumbaugh

(10) Patent No.: US 8,653,715 B1
(45) Date of Patent: Feb. 18, 2014

(54) RADIOISOTOPE-POWERED ENERGY SOURCE

(75) Inventor: Joel T. Baumbaugh, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 428 days.

(21) Appl. No.: 13/173,029

(22) Filed: Jun. 30, 2011

(51) Int. Cl.
*G21H 1/00* (2006.01)
*G21H 1/02* (2006.01)

(52) U.S. Cl.
USPC ..... 310/305; 310/301

(58) Field of Classification Search
USPC ..... 310/301–302, 303, 305; 136/253; 429/5
See application file for complete search history.

(56) References Cited

U.S. PATENT DOCUMENTS

| | | | | |
|---|---|---|---|---|
| 2,819,414 | A * | 1/1958 | Sherwood et al. | 310/303 |
| 3,706,893 | A | 12/1972 | Olsen et al. | |
| 4,242,147 | A | 12/1980 | DeToia | |
| 4,967,112 | A | 10/1990 | Day | |
| 5,082,505 | A | 1/1992 | Cota et al. | |
| 5,118,951 | A | 6/1992 | Kherani et al. | |
| 5,124,610 | A | 6/1992 | Conley et al. | |
| 5,235,232 | A | 8/1993 | Conley et al. | |
| 5,260,621 | A | 11/1993 | Little et al. | |
| 5,280,213 | A | 1/1994 | Day | |
| 5,396,141 | A | 3/1995 | Jantz et al. | |
| 5,605,171 | A | 2/1997 | Tam | |
| 5,606,213 | A | 2/1997 | Kherani et al. | |
| 5,616,928 | A | 4/1997 | Russell et al. | |
| 5,642,014 | A | 6/1997 | Hillenius | |
| 5,721,462 | A | 2/1998 | Shanks | |
| 5,825,839 | A * | 10/1998 | Baskis | 376/320 |
| 5,859,484 | A | 1/1999 | Mannik et al. | |
| 6,118,204 | A | 9/2000 | Brown | |
| 6,238,812 | B1 | 5/2001 | Brown et al. | |
| 6,479,743 | B2 | 11/2002 | Vaz | |
| 6,753,469 | B1 | 6/2004 | Kolawa et al. | |
| 6,774,531 | B1 | 8/2004 | Gadeken | |
| 6,949,865 | B2 | 9/2005 | Gadeken | |
| 7,488,889 | B2 | 2/2009 | Putnam | |
| 7,888,125 | B2 | 2/2011 | Gibbons et al. | |
| 2004/0150290 | A1 | 8/2004 | Gadeken | |
| 2006/0185719 | A1 | 8/2006 | Putnam | |
| 2008/0001497 | A1 * | 1/2008 | Wong et al. | 310/305 |
| 2010/0258189 | A1 | 10/2010 | Curran | |

* cited by examiner

*Primary Examiner* — Burton Mullins
(74) *Attorney, Agent, or Firm* — Kyle Eppele; J. Eric Anderson

(57) ABSTRACT

A radioisotope-powered energy source comprising: a flexible center substrate coated with the radioisotope, wherein the substrate comprises upper and lower surfaces; and two substantially identical sequences of layers bonded to each other and to the upper and lower surfaces via electrically insulating mesh barriers, wherein each sequence comprises the following layers bonded together in a y-direction in the following order: a first low-density alpha particle impact layer, a first high-density beta particle impact layer, a second low-density alpha particle impact layer, a second radioisotope-coated substrate, a third low-density alpha particle impact layer, a second high-density beta particle impact layer, and a photovoltaic layer.

19 Claims, 5 Drawing Sheets

| nuclide | historic name (short) | historic name (long) | decay mode | half life | MeV | product of decay |
|---|---|---|---|---|---|---|
| $^{238}U$ | U | Uranium | α | $4.468 \cdot 10^9$ a | 4.270 | $^{234}Th$ |
| $^{234}Th$ | $UX_1$ | Uranium X1 | $\beta^-$ | 24.10 d | 0.273 | $^{234m}Pa$ |
| $^{234m}Pa$ | $UX_2$ | Uranium X2 | $\beta^-$ 99.84 %<br>IT 0.16 % | 1.16 min | 2.271<br>0.074 | $^{234}U$<br>$^{234}Pa$ |
| $^{234}Pa$ | UZ | Uranium Z | $\beta^-$ | 6.70 h | 2.197 | $^{234}U$ |
| $^{234}U$ | $U_{II}$ | Uranium two | α | 245500 a | 4.859 | $^{230}Th$ |
| $^{230}Th$ | Io | Ionium | α | 75380 a | 4.770 | $^{226}Ra$ |
| $^{226}Ra$ | Ra | Radium | α | 1602 a | 4.871 | $^{222}Rn$ |
| $^{222}Rn$ | Rn | Radon | α | 3.8235 d | 5.590 | $^{218}Po$ |
| $^{218}Po$ | RaA | Radium A | α 99.98 %<br>$\beta^-$ 0.02 % | 3.10 min | 6.115<br>0.265 | $^{214}Pb$<br>$^{218}At$ |
| $^{218}At$ | | | α 99.90 %<br>$\beta^-$ 0.10 % | 1.5 sec | 6.874<br>2.883 | $^{214}Bi$<br>$^{218}Rn$ |
| $^{218}Rn$ | | | α | 35 msec | 7.263 | $^{214}Po$ |
| $^{214}Pb$ | RaB | Radium B | $\beta^-$ | 26.8 min | 1.024 | $^{214}Bi$ |
| $^{214}Bi$ | RaC | Radium C | $\beta^-$ 99.98 %<br>α 0.02 % | 19.9 min | 3.272<br>5.617 | $^{214}Po$<br>$^{210}Tl$ |
| $^{214}Po$ | RaC' | Radium C' | α | 0.1643 msec | 7.883 | $^{210}Pb$ |
| $^{210}Tl$ | RaC" | Radium C" | $\beta^-$ | 1.30 min | 5.484 | $^{210}Pb$ |
| $^{210}Pb$ | RaD | Radium D | $\beta^-$ | 22.3 a | 0.064 | $^{210}Bi$ |
| $^{210}Bi$ | RaE | Radium E | $\beta^-$ 99.99987%<br>α 0.00013% | 5.013 d | 1.426<br>5.982 | $^{210}Po$<br>$^{206}Tl$ |
| $^{210}Po$ | RaF | Radium F | α | 138.376 d | 5.407 | $^{206}Pb$ |
| $^{206}Tl$ | | | $\beta^-$ | 4.199 min | 1.533 | $^{206}Pb$ |
| $^{206}Pb$ | | | - | stable | - | - |

*Fig. 5*

RADIOISOTOPE-POWERED ENERGY SOURCE

FEDERALLY-SPONSORED RESEARCH AND DEVELOPMENT

This invention is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 100794.

BACKGROUND OF THE INVENTION

The present invention relates to self-contained power cells capable of supplying electrical energy, and more particularly to a compact energy source capable of supplying a low level of energy for a relatively long period of time.

Electric power cells provide self-contained sources of electrical energy for driving external loads. Chemical batteries are a common example of a practical electric power cells, in that they are relatively inexpensive to produce and capable of supplying a reasonably high energy output, even though it may be for a relatively short period of time. These batteries are effectively employed in a large variety of applications and environments, which can range in requirements from a very large current demand over a short period of time, such as a heavy-duty fork lift truck, to a small current demand over a long period of time, such as a small wristwatch. While chemical batteries are very effective at providing the power needs of such devices, the size and durational requirements sometimes associated with microelectronic devices are not always compatible with employment of chemical batteries. One example of a microelectronic device possibly requiring a compact, long-life, low-current battery is a nonvolatile memory circuit of a compact computing device. Another example is a low-power electronic sensor which is intended for long term unattended operation in an inaccessible location.

The amount of electrical energy supplied by chemical batteries is directly related to the mass of reactive materials incorporated in the chemical batteries. This characteristic can result in the size of a chemical battery being much larger than its load. Even a chemical battery in a modern electronic wristwatch is usually much larger in size and heavier relative to the electronic microchip circuitry which drives the watch. It is therefore desirable to provide a battery that can fit in a very small space, and preferably one which can also provide many years of uninterrupted service.

SUMMARY

Disclosed herein is a radioisotope-powered energy source comprising: a flexible center substrate, wherein the substrate comprises upper and lower surfaces which are both coated with the radioisotope or have a thin layer of the radioisotope bonded thereto; and two substantially identical sequences of layers bonded to each other and to the upper and lower surfaces via electrically insulating mesh barriers, wherein each sequence comprises the following layers bonded together in a y-direction in the following order: a first low-density alpha particle impact layer, a first high-density beta particle impact layer, a second low-density alpha particle impact layer, a second radioisotope-coated substrate, a third low-density alpha particle impact layer, a second high-density beta particle impact layer, and a photovoltaic layer.

BRIEF DESCRIPTION OF THE DRAWINGS

Throughout the several views, like elements are referenced using like references. The elements in the figures are not drawn to scale and some dimensions are exaggerated for clarity.

FIG. 5 is a table listing the Radium Series.

DETAILED DESCRIPTION OF EMBODIMENTS

Figure 1:
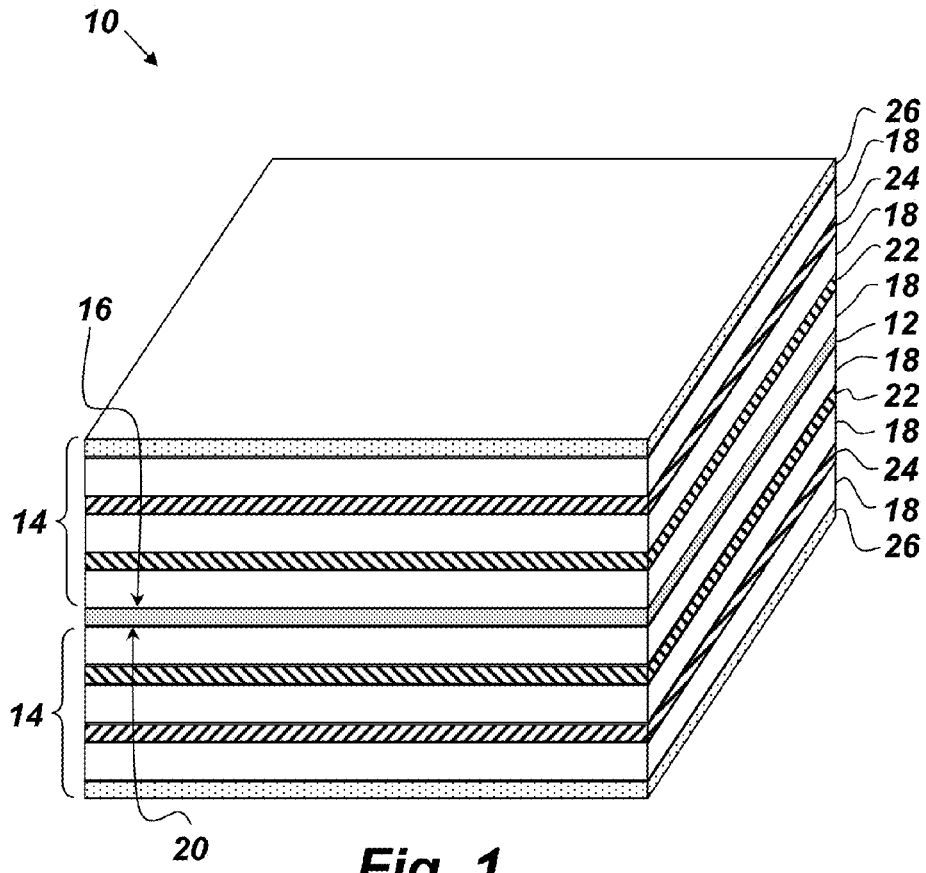
FIG. 1 is a perspective/cross-sectional view of a radioisotope-powered energy source.

FIG. 1 depicts an embodiment of a radioisotope-powered energy source 10, which comprises a radioisotope-coated flexible center substrate 12, and two substantially identical sequences of layers 14. One sequence 14 is bonded to an upper surface 16 of the center substrate 12 via an electrically insulating mesh barrier 18. The other sequence 14 is bonded to a lower surface 20 via another electrically insulating mesh barrier 18. All of the constituent layers of each sequence 14 are also bonded to each other via electrically insulating mesh barriers 18. Each sequence 14 comprises the following layers bonded together in the following order: a first low-density alpha particle impact layer 22, a first high-density beta particle impact layer 24, and a photovoltaic layer 26.

The center substrate 12 may be made of any thin flexible material that is capable of carrying a layer of the radioisotope with minimal self-absorption of the emitted alpha particulates. A suitable example of the center substrate 12 is a very thin flexible plastic matrix of a suitable actinide radioisotope. The radioisotope that coats the center substrate 12 may be any radioisotope that emits alpha and beta particles and x-ray/gamma photons. Suitable examples of the radioisotope include, but are not limited to, depleted uranium (i.e. the Radium/Uranium Series, See FIG. 5), a radioisotope from the Thorium series (e.g. Thorium 232), a radioisotope from the Neptunium series (e.g. Np-237), and a radioisotope from the Actinium series (U-235). The radioisotope may be incorporated or coated onto the substrate 12 by a number of methods including but not limited to powder coating or by other methods of adhesion. In reverse, the substrate material(s) themselves may be applied to the radioisotope (depending on whether it is in a solid or powdered form, which would help limit the possibility of contamination. In another embodiment, the substrate 12 may be a very thin layer of the radioisotope itself.

The insulating mesh barrier 18 may be any non-conductive barrier suitable for electrically insulating adjoining layers while allowing alpha and beta particles and x and gamma ray photons to pass substantially therethrough. Suitable examples of the mesh barrier 18 include ceramic, fiberglass, polymer or plastic non-conductive materials. Due to the limited range of Alpha and low energy Betas, the mesh should be as thin as practicable. The mesh openings should be sufficient in size and geometry to allow Alpha and Beta particles to pass with minimal obstruction but be sufficient to electrically insulate the Alpha and Beta collection media. The mesh barrier 18 may also serve as a thermal barrier between constituent layers of the sequences 14.

The first alpha particle impact layer 22 may be any low-density film capable of interacting with alpha particles emitted from the radioisotope and collecting the positive charge therefrom. Approximately all of the alpha particles emitted by the radioisotope will interact with, and give up their energy to, the first alpha particle impact layer 22. Suitable examples of the first alpha particle impact layer 22 include, but are not limited to, sodium beta-alumina or various silicone devices, Gallium Arsenide (GaAs) diodes, and diamond films. The first alpha particle impact layer 22 may be a solid film or a mesh design.

The first beta particle impact layer 24 may be any high-density film capable of interacting with beta particles emitted from the radioisotope and collecting the negative charge therefrom. A high percentage of emitted beta particles (electrons) will pass through the first alpha particle impact layer 22 with no interaction (and therefore no loss of negative charge) and will then interact with the first beta particle impact layer 24, which may be designed to interact with nearly all the incident beta particles that pass through the first alpha particle impact layer 22. Upon impacting the first beta particle impact layer 24, the beta particles will give up their negative charge. Suitable examples of the first beta particle impact layer 24 include, but are not limited to, a film of beryllium, carbon, silver, aluminum, and gold.

The photovoltaic layer 26 may be any photocell capable of converting x and gamma ray photons into electrical current. Many commercially-available photovoltaic materials currently exist that would be suitable for the photovoltaic layer 26. A suitable example of the photovoltaic layer includes, but is not limited to a layer of un-doped Lithium Niobate ($LiNbO_3$). U.S. Pat. No. 5,721,462, which issued 24 Feb. 1998 to Howard Shanks, which is incorporated by reference herein, provides instructions on how such a photovoltaic layer may be constructed.

Figure 2A:
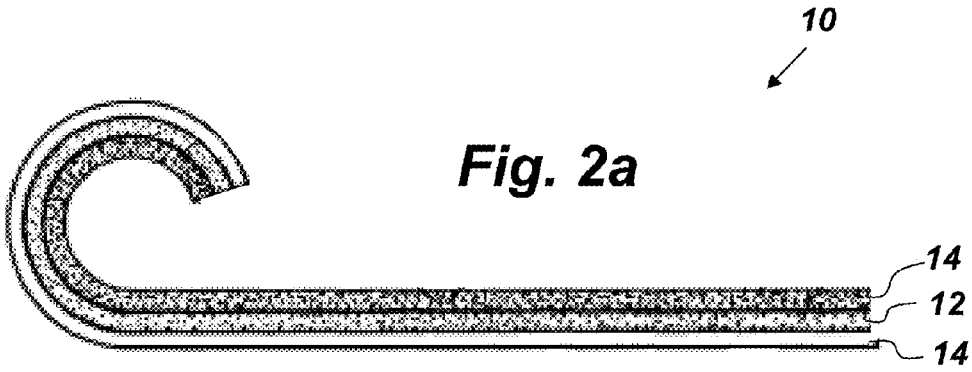
FIG. 2*a* is a side view of a radioisotope-powered energy source being rolled into a cylinder.
Figure 2B:
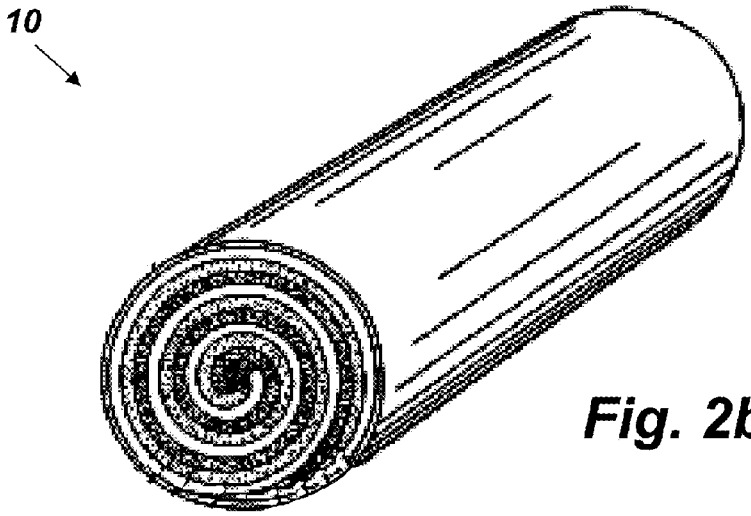
FIG. 2*b* is a perspective view of a radioisotope-powered energy source rolled into a cylinder.

FIGS. 2*a*-2*b* are illustrations showing how the energy source 10 may be assembled on a flat surface and then rolled into a cylindrical shape to enhance the interactions between the various radioactive emissions of the radioisotope coating and the sequences of layers 14. In this configuration, any high energy beta particles or photons that don't interact with the first particle-specific layer they encounter will have at least one more chance to do so. With respect to drawing scale, it will also be appreciated that the drawings, particularly those showing a rolled configuration, are not in an actual scale, but in a scale selected to best illustrate the invention. More particularly, the respective layers which make up the energy source 10 are on the order of a millimeter or less in thickness, and thus a cylindrical energy source of a given real diameter will usually contain many more layers than are shown in FIGS. 2*a*-2*b*. Specifically, FIGS. 2*a*-2*b* are intended primarily to illustrate the relationship between the respective layers, and not the number of layers which will make up this particular embodiment of the energy source 10.

Figure 3:
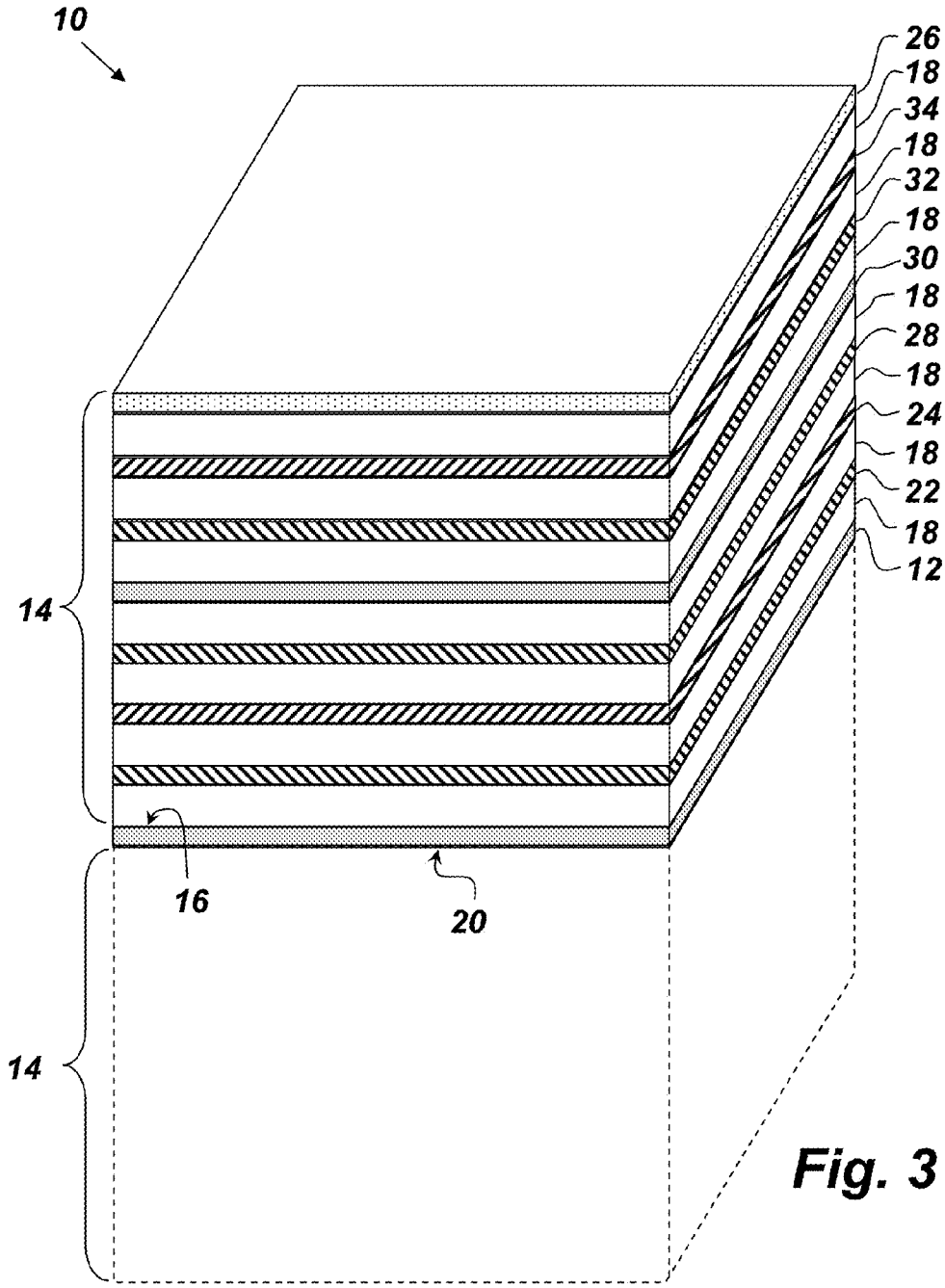
FIG. 3 is a perspective and cross-sectional view of another embodiment of a radioisotope-powered energy source.

FIG. 3 illustrates another embodiment of the sequence of layers 14. In this embodiment, the sequence 14, in addition to the layers depicted in FIG. 1, further comprises the following layers interposed between the first beta particle impact layer 24 and the photovoltaic layer 26: a second low-density alpha particle impact layer 28, a second radioisotope-coated substrate 30, a third low-density alpha particle impact layer 32, and a second high-density beta particle impact layer 34. As with the embodiment of the sequence depicted in FIG. 1, each layer is separated from adjoining layers by an insulating mesh barrier 18. Although FIG. 3 illustrates only one sequence 14 bonded to the upper surface 16 of the substrate 12, it is to be understood that this is only for the sake of ease of display and that a complete depiction of the energy source 10 would also include a mirror image of the sequence of layers 14 shown in FIG. 3 bonded to the lower surface 20.

Figure 4:
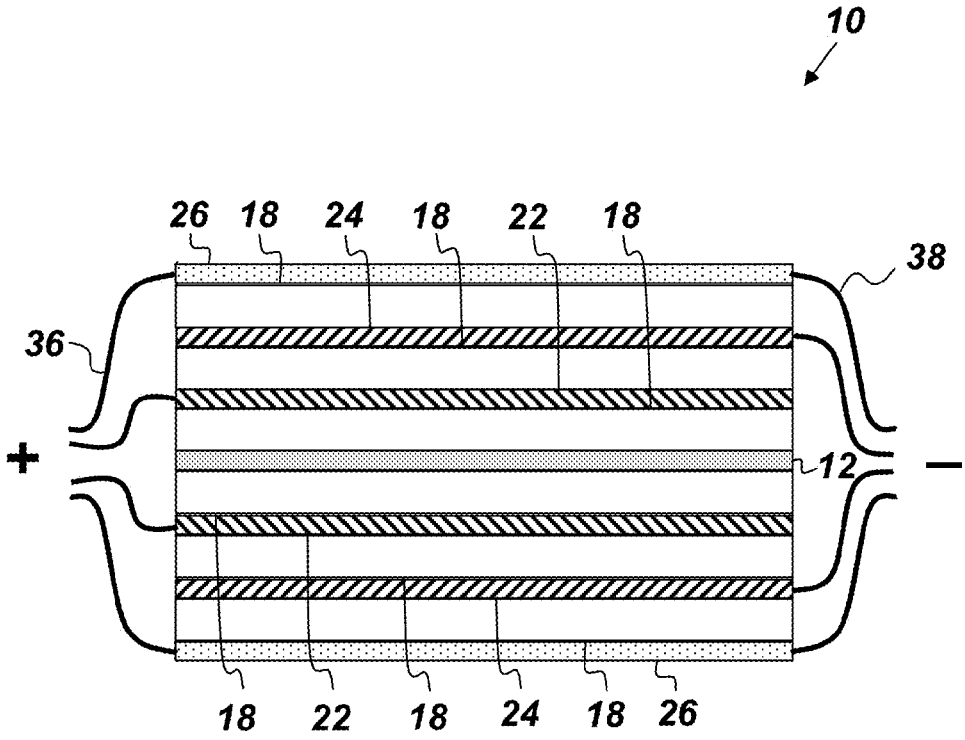
FIG. 4 is a cross-sectional view of an embodiment of a radioisotope-powered energy source.

FIG. 4 is a cross-sectional view of another embodiment of the energy source 10 showing positive leads 36 and negative leads 38 connected to the various layers. Each alpha particle impact layer 22 has a positive lead 36 connected thereto for conducting positive charge collected from the alpha particles. Each beta particle impact layer 24 has a negative lead 38 connected thereto for conducting negative charge collected from the beta particles. Each photovoltaic layer 26 has a positive lead 36 and a negative lead 38. The positive and negative leads 36 and 38 serve for connection of the energy source 10 to a load. A plurality of energy sources 10 can be formed separately or on the same substrate, and can be interconnected in series or in parallel to derive the necessary voltage and current capacities to meet the requirements of a particular load.

FIG. 5 is a table showing the 4n+2 chain of U-238, which is commonly called the "radium series" (or sometimes "uranium series"). Beginning with naturally occurring uranium-238, the radium series includes the following elements: astatine, bismuth, lead, polonium, protactinium, radium, radon, thallium, and thorium. All are present, at least transiently, in any uranium-containing sample, whether metal, compound, or mineral.

From the above description of the energy source 10, it is manifest that various techniques may be used for implementing the concepts of the energy source 10 without departing from its scope. The described embodiments are to be considered in all respects as illustrative and not restrictive. It should also be understood that energy source 10 is not limited to the particular embodiments described herein, but is capable of many embodiments without departing from the scope of the claims.

What is claimed is:

1. A radioisotope-powered energy source comprising:

a flexible center substrate coated with the radioisotope, wherein the substrate comprises upper and lower surfaces; and two substantially identical sequences of layers bonded to the substrate via electrically insulating mesh barriers, one of the sequences being bonded to the upper surface and the other sequence being bonded to the lower surface, wherein the constituent layers of each sequence are bonded to each other via electrically insulating mesh barriers, wherein each sequence comprises the following layers bonded together in the following order:

a first low-density alpha particle impact layer, a first high-density beta particle impact layer, and a photovoltaic layer.

2. The energy source of claim 1, wherein each sequence further comprises the following layers interposed between the first beta particle impact layer and the photovoltaic layer:

a second low-density alpha particle impact layer, a second radioisotope-coated substrate, a third low-density alpha particle impact layer, and a second high-density beta particle impact layer.

3. The energy source of claim 1, wherein all constituent layers of the energy source are rolled into a cylindrical shape.

4. The energy source of claim 3, wherein each photovoltaic, alpha particle impact, and beta particle impact layer is electrically connected to a capacitor.

5. The energy source of claim 3, wherein the radioisotope is depleted uranium.

6. The energy source of claim 3, wherein the radioisotope is a radioisotope from the Thorium series.

7. The energy source of claim 3, wherein the radioisotope is a radioisotope from the Neptunium series.

8. The energy source of claim 3, wherein the radioisotope is an artificially created radioisotope.

9. The energy source of claim 3, wherein each beta particle impact layer is a beryllium film.

10. The energy source of claim 3, wherein each beta particle impact layer is a carbon film.

11. The energy source of claim 3, wherein each beta particle impact layer is a silver film.

12. The energy source of claim 3, wherein each beta particle impact layer is a gold film.

13. The energy source of claim 3, wherein each alpha particle impact layer is a sodium beta-alumina device.

14. The energy source of claim 3, wherein each alpha particle impact layer is a gallium arsenide diode.

15. The energy source of claim 3, wherein each alpha particle impact layer is a diamond film.

16. A radioisotope-powered energy source comprising:

a flexible center substrate coated with the radioisotope, wherein the substrate comprises upper and lower surfaces;

first and second electrically insulating mesh barriers coupled to the upper and lower surfaces respectively;

first and second low-density alpha particle impact layers coupled to the first and second mesh barriers respectively;

third and fourth electrically insulating mesh barriers coupled to the first and second alpha particle impact layers respectively; and first and second high-density beta particle impact layers coupled to the third and fourth mesh barriers respectively;

fifth and sixth electrically insulating mesh barriers coupled to the first and second beta particle impact layers; and first and second photovoltaic layers coupled to the third and fourth electrically insulating mesh barriers.

17. The energy source of claim 16, further comprising the following layers which are interposed between the fifth and sixth mesh barriers and the first and second photovoltaic layers respectively:

third and fourth alpha particle impact layers coupled to the fifth and sixth mesh barriers respectively;

seventh and eighth electrically insulating mesh barriers coupled to the third and fourth alpha particle impact layers respectively;

second and third flexible substrates coated with the radioisotope, wherein the second and third substrates are coupled to the seventh and eighth mesh barriers respectively;

ninth and tenth electrically insulating mesh barriers coupled to the second and third substrates respectively;

fifth and sixth alpha particle impact layers coupled to the ninth and tenth mesh barriers respectively;

eleventh and twelfth electrically insulating mesh barriers coupled to the fifth and sixth alpha particle impact layers respectively; and third and fourth beta particle impact layers coupled to the eleventh and twelfth mesh barriers respectively and to the first and second photovoltaic layers respectively.

18. A depleted uranium energy source comprising:

a flexible center layer of the depleted uranium, wherein the center layer comprises upper and lower surfaces; and two substantially identical sequences of layers bonded to the center layer via electrically insulating mesh barriers, one of the sequences being bonded to the upper surface and the other sequence being bonded to the lower surface, wherein the constituent layers of each sequence are bonded to each other via electrically insulating mesh barriers, wherein each sequence comprises the following layers bonded together in a y-direction in the following order:

a first low-density alpha particle impact layer, a first high-density beta particle impact layer, a second low-density alpha particle impact layer, a second depleted-uranium-coated substrate, a third low-density alpha particle impact layer, a second high-density beta particle impact layer, and a photovoltaic layer.

19. The depleted uranium energy source of claim 18, wherein the total thickness of the energy source in the y-direction is smaller than the width or length of the energy source in x- and z-directions, and wherein the energy source is rolled into a cylindrical shape.

* * * * *